US009558668B2

(12) United States Patent
Letsu-Dake et al.

(10) Patent No.: US 9,558,668 B2
(45) Date of Patent: Jan. 31, 2017

(54) SYSTEMS AND METHODS FOR IMPROVING AN IN-TRAIL PROCEDURES REQUEST

(75) Inventors: Emmanuel Letsu-Dake, Shakopee, NM (US); Dave Pepitone, Sun City West, AZ (US); Craig Schimmel, Rio Rancho, NM (US); Joe Rakolta, Albuquerque, NM (US); John Fugedy, Placitas, NM (US)

(73) Assignee: Honeywell International Inc., Morris Plains, NJ (US)

( * ) Notice: Subject to any disclaimer, the term of this patent is extended or adjusted under 35 U.S.C. 154(b) by 949 days.

(21) Appl. No.: 12/912,135

(22) Filed: Oct. 26, 2010

(65) Prior Publication Data

US 2012/0102422 A1 Apr. 26, 2012

(51) Int. Cl.
*G08B 23/00* (2006.01)
*G08G 5/00* (2006.01)

(52) U.S. Cl.
CPC ..... *G08G 5/0013* (2013.01); *G08G 5/0021* (2013.01); *G08G 5/0039* (2013.01); *G08G 5/0052* (2013.01)

(58) Field of Classification Search
CPC ... G08G 5/0013; G08G 5/0039; G08G 5/0052
USPC ..... 340/970, 945, 971, 963; 701/1, 3, 120
See application file for complete search history.

(56) References Cited

U.S. PATENT DOCUMENTS 5,383,098 A * 1/1995 Ma et al. ..... 361/818
5,682,291 A * 10/1997 Jeffries et al. ..... 361/679.58
6,289,277 B1 9/2001 Feyereisen et al.
6,389,355 B1 5/2002 Gibbs et al.
6,433,729 B1 8/2002 Staggs
6,507,377 B1 * 1/2003 Jung ..... 349/60
6,616,106 B1 * 9/2003 Dean et al. ..... 248/27.1
6,654,078 B1 * 11/2003 Kato et al. ..... 349/58
(Continued)

FOREIGN PATENT DOCUMENTS

CN 1209897 A 3/1999
CN 101019004 A 8/2007
(Continued)

OTHER PUBLICATIONS

European Search Report from the counterpart European patent application 11177856.9 dated Dec. 15, 2011. 3 pages.
(Continued)

*Primary Examiner* — Kerri McNally
(74) *Attorney, Agent, or Firm* — Shumaker & Sieffert, P.A.

(57) ABSTRACT

Systems and methods for improving the reception and delivery of an In-Trail Procedures (ITP) altitude change request. An example system located on board a host aircraft includes a communication component, a display device and a processor unit that is in signal communication with the communication component and the display device. The processor unit presents a user interface on the display device. The user interface includes a plurality of fields for receiving In-Trail Procedures (ITP) altitude change request information. The processor sends the ITP altitude change request information received within the plurality of fields to an Air Traffic Control (ATC) facility via the communication component. An ITP unit having a display receives an altitude selection and presents ITP altitude change request information if the received altitude selection is determined to be valid.

8 Claims, 7 Drawing Sheets

(56) References Cited

U.S. PATENT DOCUMENTS

| | | | | |
|---|---|---|---|---|
| 6,894,739 | B2 * | 5/2005 | Sung et al. | 349/58 |
| 7,004,614 | B2 * | 2/2006 | Tsai et al. | 362/633 |
| 7,209,195 | B2 * | 4/2007 | Lin | 349/58 |
| 7,236,357 | B2 * | 6/2007 | Chen | 361/679.55 |
| 7,429,700 | B2 * | 9/2008 | Kanamaru et al. | 174/50 |
| 7,471,995 | B1 | 12/2008 | Robinson | |
| 7,525,795 | B2 * | 4/2009 | Cheng | 361/679.33 |
| 7,570,178 | B1 | 8/2009 | Whalen et al. | |
| 7,570,313 | B2 * | 8/2009 | Wu et al. | 349/58 |
| 7,642,452 | B2 * | 1/2010 | Kanazawa et al. | 174/50 |
| 7,646,313 | B2 | 1/2010 | Winkler et al. | |
| 7,712,621 | B2 * | 5/2010 | Cho et al. | 220/4.28 |
| 7,940,287 | B2 * | 5/2011 | Kim et al. | 349/60 |
| 8,101,859 | B2 * | 1/2012 | Zadesky | 174/50 |
| 2003/0006928 | A1 | 1/2003 | Szeto et al. | |
| 2003/0048204 | A1 | 3/2003 | Qureshi | |
| 2003/0193410 | A1 | 10/2003 | Chen et al. | |
| 2005/0049762 | A1 | 3/2005 | Dwyer | |
| 2006/0146486 | A1 * | 7/2006 | Wikstrom et al. | 361/681 |
| 2006/0227502 | A1 * | 10/2006 | Cheng | 361/685 |
| 2007/0052100 | A1 * | 3/2007 | Bellinger | 257/758 |
| 2007/0200731 | A1 | 8/2007 | Winkler et al. | |
| 2008/0013087 | A1 * | 1/2008 | Bailey et al. | 356/399 |
| 2008/0048958 | A1 * | 2/2008 | Kim et al. | 345/87 |
| 2008/0158810 | A1 * | 7/2008 | Liu et al. | 361/685 |
| 2008/0247127 | A1 * | 10/2008 | Finnegan | 361/681 |
| 2009/0037037 | A1 * | 2/2009 | Mettes | 701/14 |
| 2009/0152415 | A1 * | 6/2009 | Yang et al. | 248/201 |
| 2010/0030401 | A1 | 2/2010 | Rogers et al. | |
| 2010/0057362 | A1 | 3/2010 | Schilke et al. | |
| 2010/0194628 | A1 | 8/2010 | Christianson et al. | |
| 2010/0286900 | A1 * | 11/2010 | Depape et al. | 701/120 |
| 2010/0332054 | A1 * | 12/2010 | Brandao et al. | 701/3 |
| 2011/0006918 | A1 | 1/2011 | Shafaat et al. | |
| 2011/0144833 | A1 * | 6/2011 | Tjorhom et al. | 701/3 |
| 2011/0209376 | A1 * | 9/2011 | Kinno | 40/790 |
| 2011/0257874 | A1 | 10/2011 | Judd et al. | |
| 2011/0270472 | A1 | 11/2011 | Shafaat et al. | |
| 2011/0270473 | A1 | 11/2011 | Reynolds et al. | |
| 2011/0282568 | A1 | 11/2011 | Khatwa et al. | |
| 2011/0295450 | A1 | 12/2011 | Boorman et al. | |
| 2012/0004793 | A1 | 1/2012 | Block | |
| 2012/0179307 | A1 | 7/2012 | Boorman et al. | |
| 2012/0203448 | A1 | 8/2012 | Pepitone et al. | |

FOREIGN PATENT DOCUMENTS

| | | | |
|---|---|---|---|
| EP | 1947624 | A1 | 7/2008 |
| EP | 2071542 | A2 | 6/2009 |
| EP | 2159544 | A1 | 3/2010 |
| EP | 2267683 | A2 | 12/2010 |
| WO | 02099769 | A1 | 12/2002 |

OTHER PUBLICATIONS

Examination Report from the counterpart European patent application 11177856.9 dated Dec. 28, 2011. 6 pages.

Response to Examination Report from the counterpart European patent application 11177856.9 filed Jun. 13, 2012. 8 pages.

Examination Report from the counterpart European patent application 11177856.9 dated Jun. 27, 2012. 5 pages.

Response to Examination Report from the counterpart European patent application 11177856.9 filed Nov. 2, 2012. 4 pages.

Summons to attend oral proceedings from the counterpart European patent application 11177856.9 dated Dec. 20, 2012. 3 pages.

Response to Summons to attend oral proceedings from the counterpart European patent application 11177856.9 filed Feb. 3, 2013. 8 pages.

Decision of Grant from the counterpart European patent application 11177856.9 dated Jun. 20, 2013. 2 pages.

Dickinson et al., "Feasibility Study of ATN Baseline 1 Avionics Use for U.S. Oceanic Air Traffic Control Operations," Proceedings of the 19th Digital Avionics Systems Conference, Oct. 2000, pp. 7E5/1-7E5/7.

First Office Action, and translation thereof, from Counterpart Chinese Patent Application No. 201110301255.8, dated Nov. 17, 2014, 19 pp.

Second Office Action and Search Report, and translation thereof, from counterpart Chinese Patent Application No. 201110301255.8, dated Jun. 15, 2015, 12 pp.

* cited by examiner

SYSTEMS AND METHODS FOR IMPROVING AN IN-TRAIL PROCEDURES REQUEST

GOVERNMENT INTEREST

The invention described herein was made in the performance of work under U.S. Government Contract No. DTFAWA-09-A-00001 with the FAA. The Government may have rights to portions of this invention.

BACKGROUND OF THE INVENTION

The Federal Aviation Administration (FAA) continues to require airborne Automatic Dependent Surveillance-Broadcast (ADS-B) applications to provide improved benefits to operators. One of the benefits of ADS-B is the In-Trail Procedures (ITP). In addition to increasing flight crew awareness of the traffic around them, ITP displays offer information for safely climbing or descending through altitudes.

Currently, datalinking allows digital text messaging between controllers and pilots. ITP using Controller-Pilot Datalink Communication (CPDLC) for datalinking requires the use of structured and defined message sets consisting of uplink and downlink messages. A major concern with using CPDLC in general is the amount of heads-down time in the cockpit. It is critical that heads-down time be mitigated. Part of this mitigation is a requirement that pilots be able to quickly find, compose, and send ITP requests to Air Traffic Control (ATC). Also, wrongly formulating the ITP datalink messages by, for example, not adhering to the standard message formats, not providing all required ITP information, or entering the wrong variables will result in communication errors and delays. Evidence of this problem is mentioned in a NASA study titled "Enhanced Oceanic Operations Human-In-The-Loop In-Trail Procedure Validation Simulation Study" (NASA/TP-2008-215313).

Currently a touch panel display on an Electronic Flight Bag (EFB) display device is used for composing and sending ITP altitude change requests to ATC. The setting up and sending of an ITP clearance via an Electronic Flight Bag (EFB) device is cumbersome and because free text is used, it can be prone to error.

SUMMARY OF THE INVENTION

The present invention provides systems and methods for improving the reception and delivery of an In-Trail Procedures (ITP) altitude change request. An example system is located on board a host aircraft. The system includes a communication component, a display device and a processor unit that is in signal communication with the communication component and the display device. The processor unit presents a user interface on the display device. The user interface includes a plurality of fields for receiving In-Trail Procedures (ITP) altitude change request information. The processor sends the ITP altitude change request information received within the plurality of fields to an Air Traffic Control (ATC) facility via the communication component.

In one aspect of the invention, the system includes an ITP unit having a display. The ITP unit receives an altitude selection and presents ITP altitude change request information if the received altitude selection is determined to be valid.

In another aspect of the invention, the display device includes a Multipurpose Control Display Unit (MCDU).

In still another aspect of the invention, the plurality of fields include the selected altitude, direction of the host aircraft to the selected altitude, aircraft identification for one or more reference aircraft, distance of the one or more reference aircraft from the host aircraft and location information of the one or more reference aircraft relative to the host aircraft.

BRIEF DESCRIPTION OF THE DRAWINGS

Preferred and alternative embodiments of the present invention are described in detail below with reference to the following drawings.

DETAILED DESCRIPTION OF THE INVENTION

Figure 1:
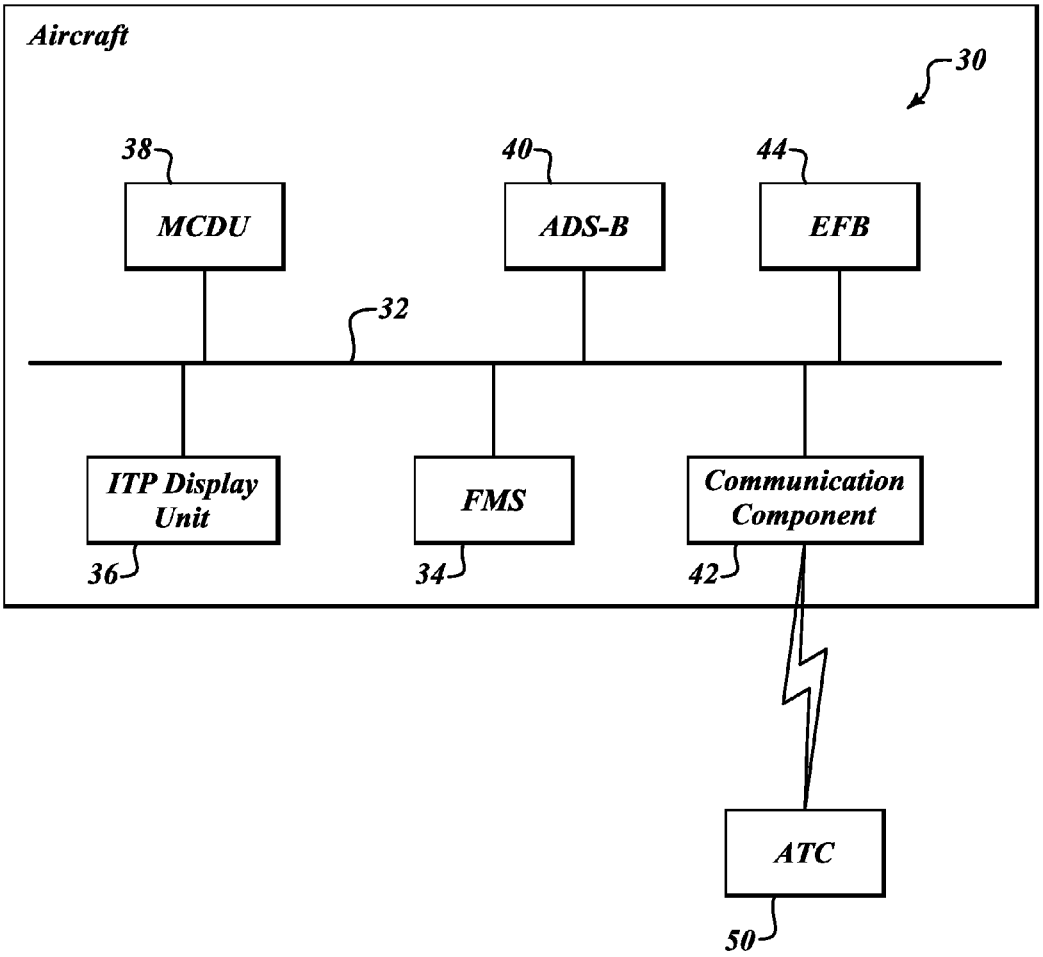
FIG. 1 is a schematic block diagram of an exemplary system formed in accordance with an embodiment of the present invention.

FIG. 1 is an exemplary schematic block diagram of an In-Trail Procedures (ITP) system 30 located on an aircraft. The ITP system 30 includes a Flight Management System (FMS) 34, an ITP display unit 36, a Multipurpose Control Display Unit (MCDU) 38, an Automatic Dependent Surveillance-Broadcast (ADS-B) component 40, a communication component 42, and an Electronic Flight Bag (EFB) 44, which are all connected to an Avionics Standard Communication Bus (ASCB) 32. The EFB 44 includes ITP standards information in accordance with applicable airline standards. The ITP standards information is communicated along the ASCB 32 to the ITP display unit 36. The ITP display unit 36 presents free text of an ITP altitude change request as processed according to the ITP standards information, data received from the FMS 34 and other proximate aircraft information received via the ADS-B system 40. The pilots then enter the displayed free text of the ITP altitude change request into an ITP altitude change request template provided by the MCDU 38. Upon entry of the ITP altitude change request into the ITP altitude change request template on the MCDU 38, the pilots then send the ITP altitude change request to an Air Traffic Controller (ATC) 50 via the ASCB 32 and the communication component 42, which is in communication with the ATC 50.

Figure 2:
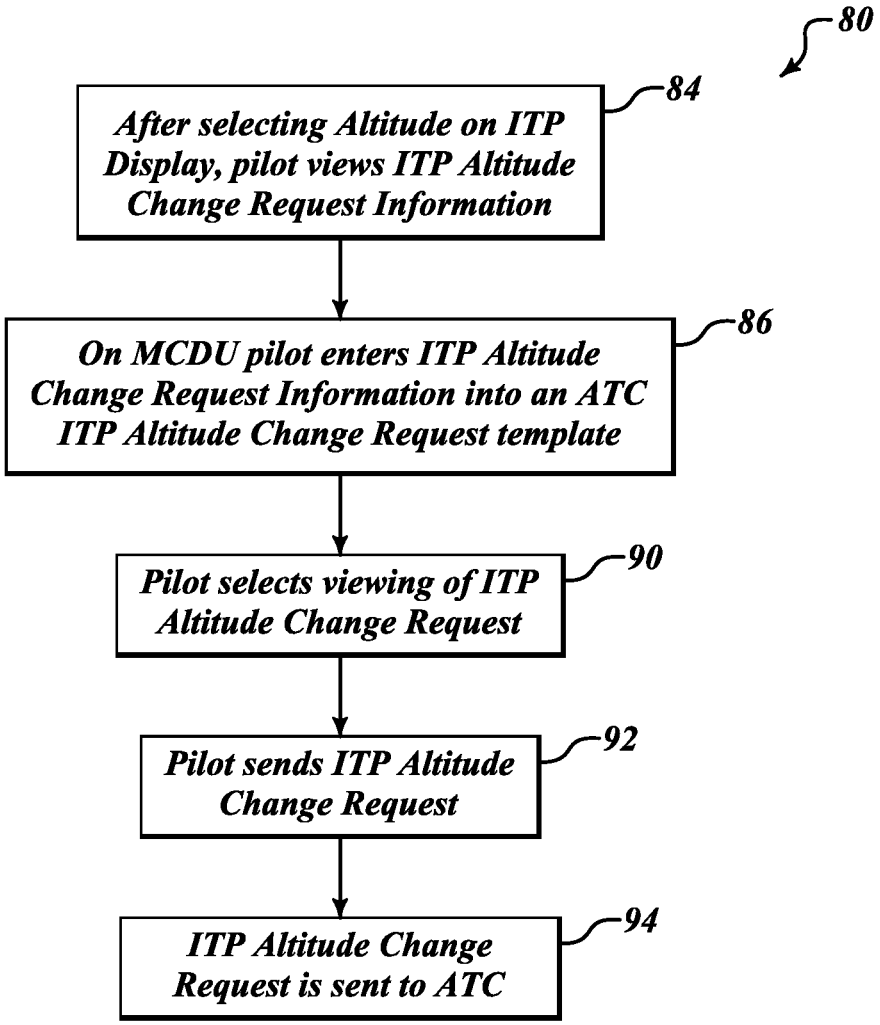
FIG. 2 is a flowchart of an exemplary process performed by the system shown in FIG. 1.

FIG. 2 illustrates an exemplary process 80 performed by the system 30. First, at a block 84, the pilot views ITP altitude change request information on the ITP display unit 36 after the pilot has selected a valid altitude via a user interface associated with the ITP display unit 36. Next, at a block 86, the pilot enters the ITP altitude change request information into an ATC ITP altitude change request template accessed on the MCDU 38. After the pilot has successfully entered the ITP altitude change request information into the ATC ITP altitude change request template, the pilot selects viewing of the ATC ITP altitude change request, see block 90. At this step, the MCDU 38 retrieves the data entered by the pilot into the ATC ITP request template and creates a free-text ITP altitude change request and displays it to the pilot on the display of the MCDU 38. Next, at a block 92, if the pilot believes that the displayed ATC ITP altitude change request is accurate, then the pilot activates a send button, thereby causing the MCDU 38 to send the ATC ITP altitude change request to the ATC 50 via the communication component 42, see block 94.

Figure 3:
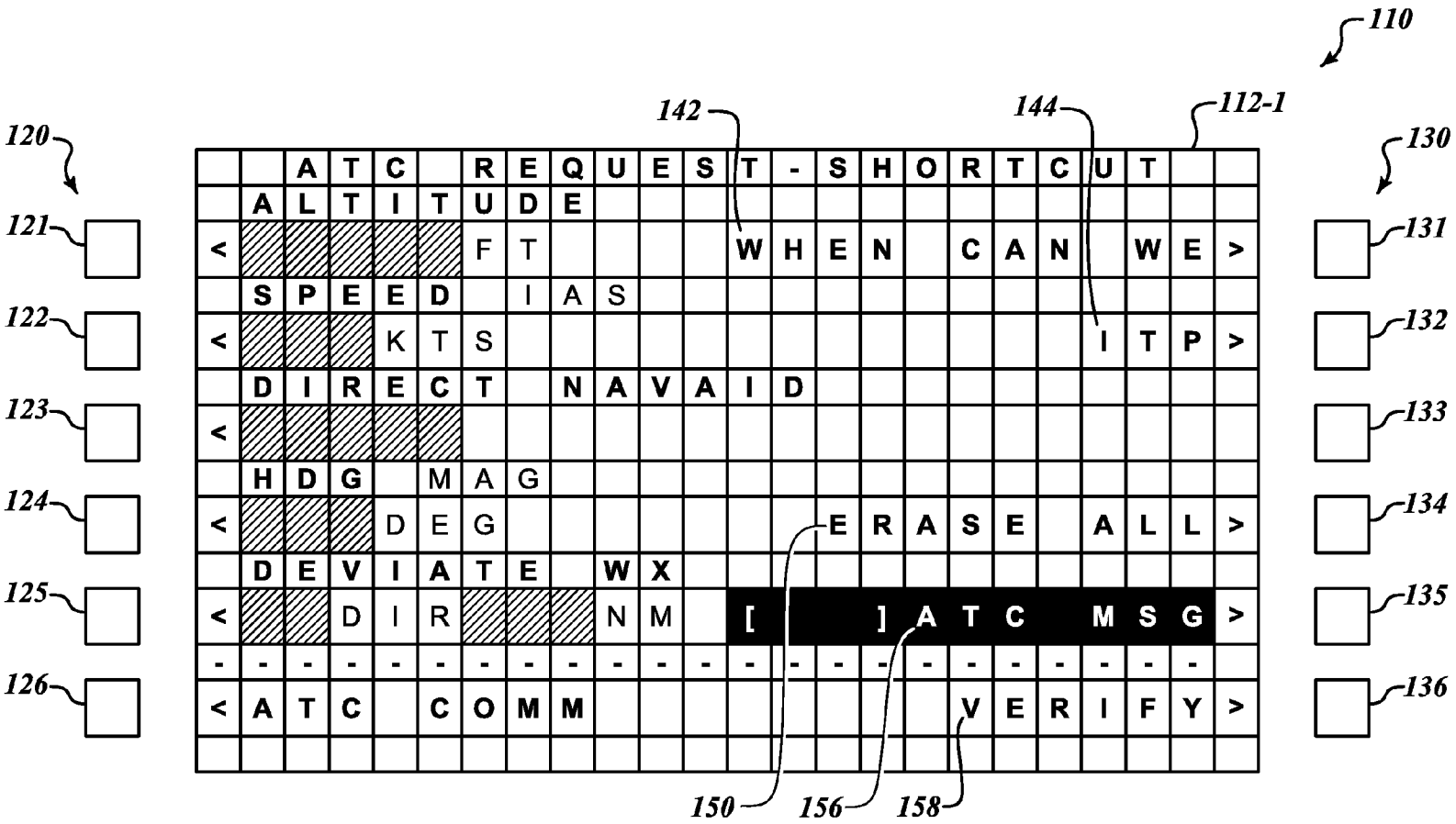
FIGS. 3 and 4 illustrate a portion of user interface components of an exemplary Multipurpose Control Display Unit (MCDU) formed in accordance with an embodiment of the present invention.

FIG. 3 illustrates an ATC comm page 112-1 that is displayed on a display 110 of the MCDU 38 upon pilot selection of an ATC communication (ATC COMM) button 140 (shown below in FIG. 6) located below the display of the MCDU 38. Also shown in FIG. 3 are a first column of six buttons 120 located adjacent a left side of the MCDU display 110 and a second column of six buttons 130 located adjacent a right edge of the MCDU display 110. The buttons 120, 130 are referred to as Left/Right Line Select Keys that are identified as 1L-6L and 1R-6R. The keys provide access to the on-side data the left and right data fields. The keys transfer data from a scratch pad (not shown—located below button 126) to the line next to the key if scratch pad data is acceptable.

The ATC comm page 112-1 includes left and right columns of selectable items/fields. The selectable items/fields are populated by desired data entered into the scratch pad after activation of an associated button from one of the first or second button columns 120, 130. This interface construct is used throughout operation of the MCDU 38. The ATC comm page 112-1 includes a first selectable item 142 that is selected upon activation of a first button 131 in the second column of buttons 130. The activation of the first selectable item 142 titled "WHEN CAN WE" opens a template for sending acceptable clearances to ATC, e.g. WE CAN ACCEPT FL340.

Figure 4:
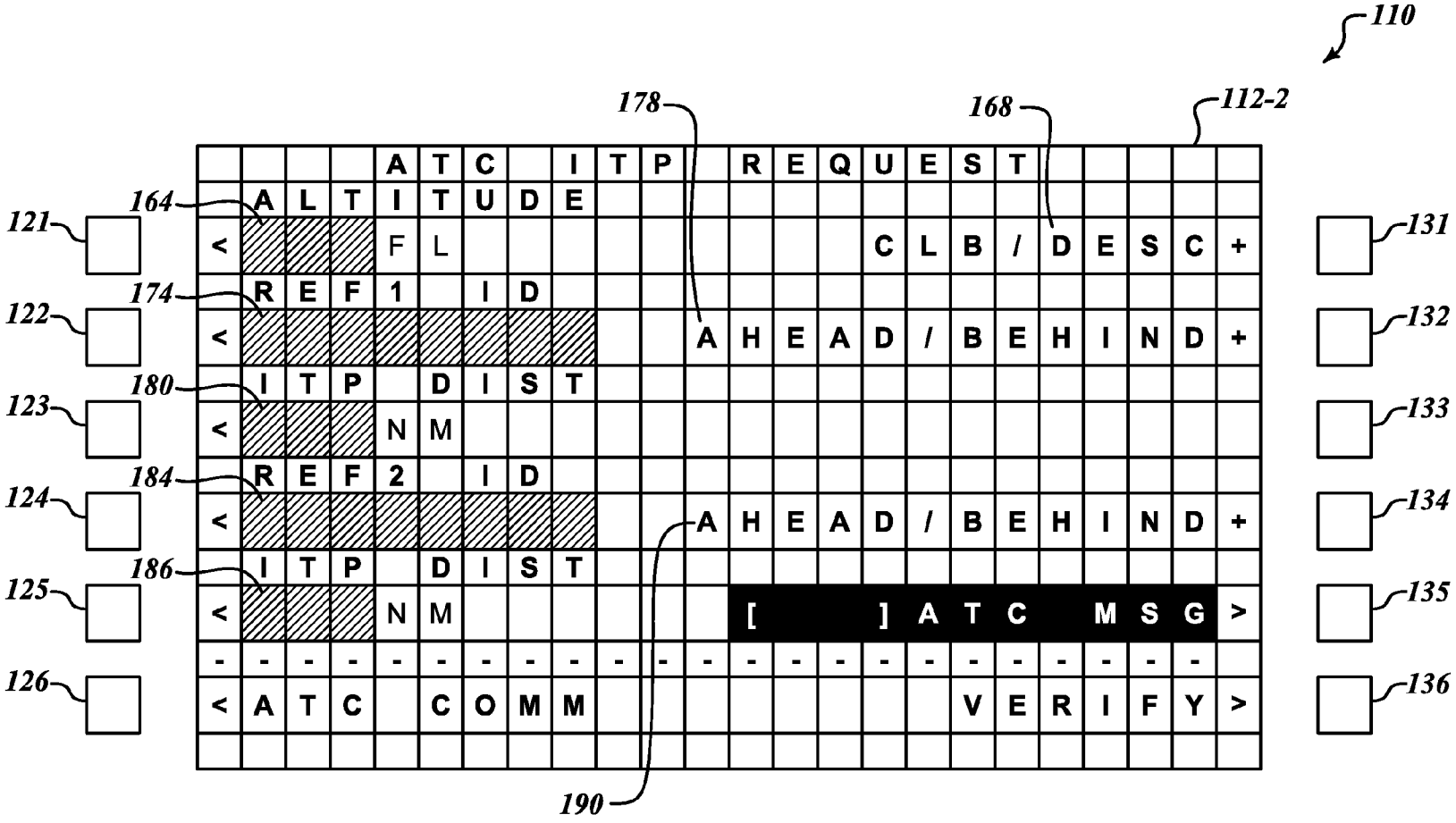

The user interface 112-1 includes a second selectable item 144 titled "ITP" that is associated with a second button 132 in the second column of buttons 130. Activation of the second button 132 presents a Controller-Pilot Datalink Communications (CPDLC) template 112-2, as shown in FIG. 4 and described in more detail below. Also included in the user interface 112-1 is an "ERASE ALL" selectable item 150 that is activated upon selection of a fourth button 134 located in the second column of buttons 130. Activation of the fourth button 134 erases all data that has been entered into any of the fields located in the user interface 112-1. The user interface 112-1 also includes an ATC message (MSG) selectable item 156 that is associated with a fifth button 135 located in the second column of buttons 130. The number displayed in the [ ] adjacent to "ATC MSG" indicates the number of unread ATC messages. Selection of the button 135 presents the first (in order received) unread ATC message to the user on the MCDU. Below the ATC MSG selectable item 156 is a "VERIFY" selectable item 158 associated with a sixth button 136 of the second column of buttons 130. Activation of the sixth button 136 displays the ATC message to be sent to ATC based on the information entered in the template for verification prior to sending. Activation of the button 126 adjacent to an "ATC COMM" selectable item, returns the MCDU to a main page index for ATC COMM.

The other fields in the user interface 112-1 allow for quick sending of a request to ATC (including concatenated ones e.g. ALT+SPEED) without having to go through detail pages which may require further information such as reasons for the request.

FIG. 4 illustrates the ITP altitude change request or ITP CPDLC template 112-2 for entering ITP altitude change request information. The ITP CPDLC template 112-2 includes on a left side of the display 110 an altitude field 164 that allows a user, upon activation of a first button 121 in the first column of buttons 120, to enter the altitude that the pilot requests. Adjacent to the field 164 in the same row is a climb and descend (CLB/DESC) selection item 168 which is associated with the first button 131 in the second column of buttons 130. The first button 131 in the second column of buttons 130 is selected by the pilot in order to toggle a selection between either climbing or descending, which is an indication of whether the aircraft will need to climb or descend to the altitude entered in the altitude field 164. Below the altitude field 164 is a first reference aircraft ID field 174 that is associated with a second button 122 in the first column of buttons 120. Upon activation of the second button 122 in the first column of buttons 120, the user enters the flight ID of a first reference aircraft that was presented in the ITP display unit 36 or included in the free text of the ITP altitude change request. In a corresponding row with the reference ID field 174 is an ahead/behind item 178, which is associated with the second button 132 in the second column of buttons 130. Upon activation of the second button 132 in the second column of buttons 130 the pilot can identify whether the current (ITP) aircraft 174 is either ahead of or behind the aircraft associated with the reference ID entered into the first reference aircraft ID field. Below the first reference aircraft ID field 174 is an ITP distance field 180 associated with the first reference aircraft ID. The first reference aircraft ITP distance field 180 is associated with a third button 123 in the first column of buttons 120. Upon pilot activation of the third button 123, the pilot can enter the associated ITP distance information into the ITP distance field 180.

The ITP CPDLC template 112-2 includes fields 184, 186, 190 for entering information for a second reference aircraft. The fields 184, 186, 190 are associated with buttons in the first and second columns of buttons 120, 130 and function in a similar manner as the fields associated with the first reference aircraft, as described above.

Figure 5:
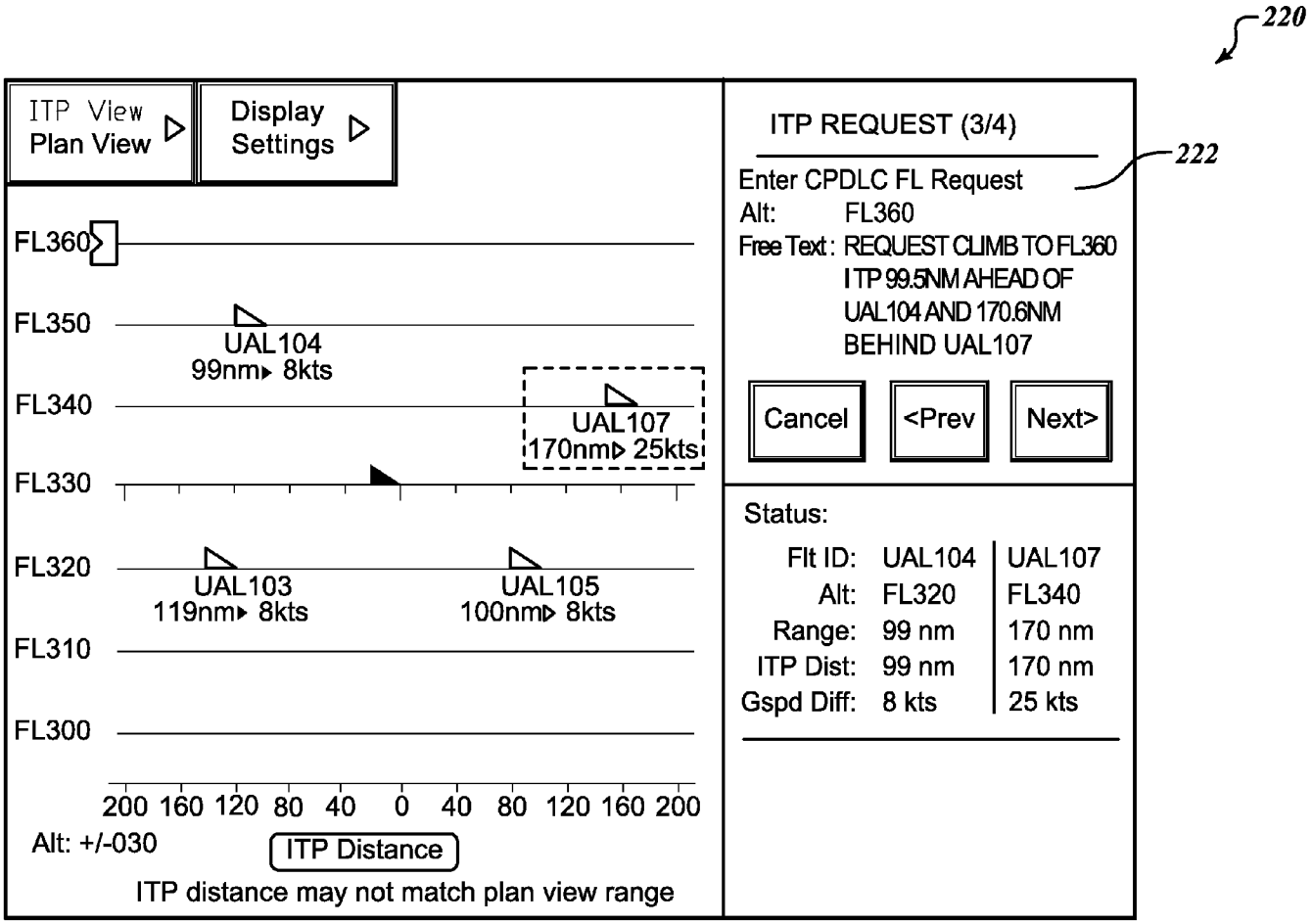
FIG. 5 illustrates a screen shot of an In-Trail Procedures (ITP) display.

FIG. 5 illustrates a screen shot of an ITP display 220 after the pilot has selected an altitude on a vertical profile section of the ITP display 220. In an ITP request section 222 of the ITP display 220 free text of an ITP altitude change request associated with the user flight level selection is displayed. The free text displayed in the ITP request section 222 is used by the pilot when filling out the ITP user interface template 112-2.

Figure 6:
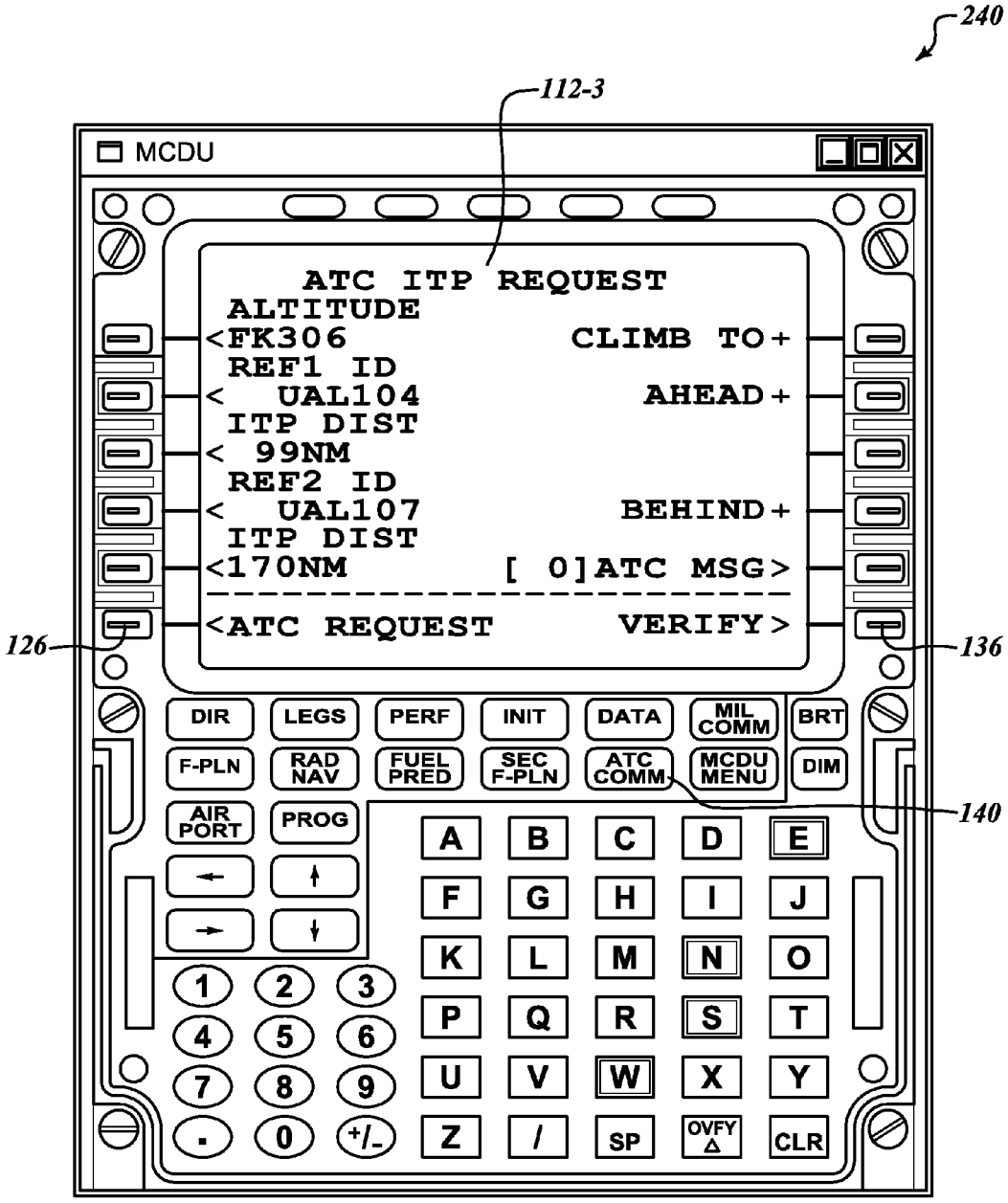
FIG. 6 illustrates an example of a user-completed ITP request template on the MCDU.

FIG. 6 illustrates a completed ITP altitude change request template 112-3 that has been filled out by the pilot after viewing the free text presented on the ITP display 220. After the user has entered the information into the ITP altitude change request template 112-3, the user selects button 136 associated with VERIFY in order to display free text of the ITP altitude change request.

Figure 7:
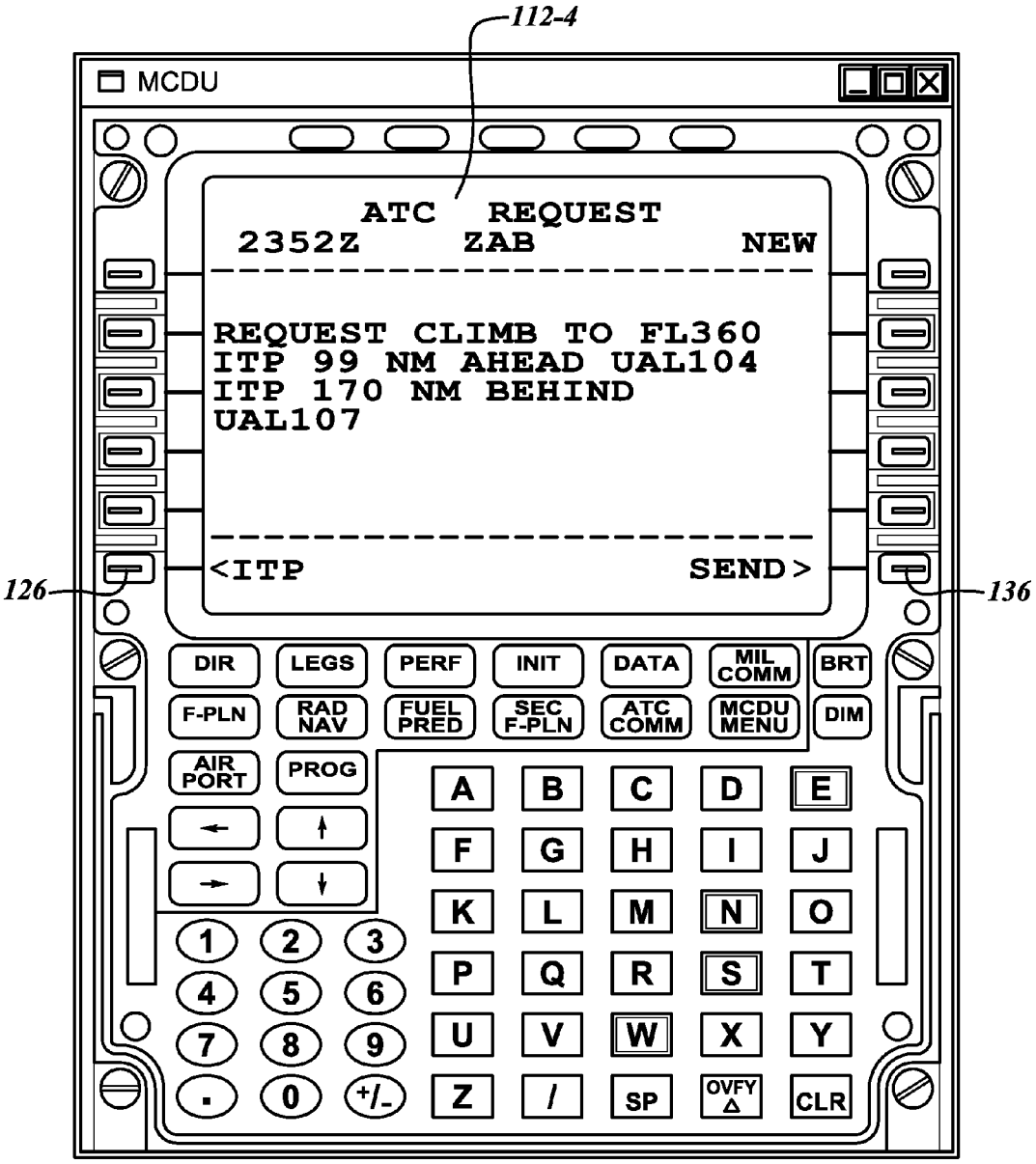
FIG. 7 illustrates an ITP request in free-text form displayed on a window of the MCDU.

FIG. 7 shows a window 112-4 of the free text of the ITP altitude change request based on the information entered in the ITP altitude change request template 112-3 shown in FIG. 6. Activation of the sixth button 136 in the second column of buttons 130 sends the displayed free text to be sent to the ATC 50 via the ASCB 32.

While the preferred embodiment of the invention has been illustrated and described, as noted above, many changes can be made without departing from the spirit and scope of the invention. Accordingly, the scope of the invention is not limited by the disclosure of the preferred embodiment.

Instead, the invention should be determined entirely by reference to the claims that follow.

The embodiments of the invention in which an exclusive property or privilege is claimed are defined as follows:

1. A system located on board a host aircraft, the system comprising:

an In-Trail Procedures (ITP) unit comprising an ITP display device, wherein the ITP unit is configured to:

receive an altitude selection;

determine that the altitude selection is valid; and after determining that the received altitude selection is valid, present ITP altitude change request information, based on the received altitude selection, at an ITP user interface associated with the ITP display device;

a communication component; and a multifunction control display unit (MCDU) comprising a MCDU display device, the MCDU being distinct from the ITP unit, the MCDU being in signal communication with the communication component, and the MCDU being configured to:

present an MCDU user interface at the MCDU display device, the MCDU user interface comprising an ITP altitude change request template for creating a free-text ITP altitude change request, the ITP altitude change request template comprising a plurality of fields for receiving ITP altitude change request information based on the ITP altitude change request information being presented at the ITP display device of the ITP unit;

create a free-text ITP altitude change request from the ITP altitude change request information received in the plurality of fields of the ITP altitude change request template and further based on content of the plurality of fields; and send the created free-text ITP altitude change request to an Air Traffic Control (ATC) facility via the communication component.

2. The system of claim 1, wherein the plurality of fields comprise:

the selected altitude of the host aircraft;

aircraft identification for one or more reference aircraft;

distance of the one or more reference aircraft from the host aircraft; and location information of the one or more reference aircraft relative to the host aircraft.

3. A method performed on board a host aircraft, the method comprising:

at an In-Trail Procedures (ITP) unit comprising an ITP display device:

receiving an altitude selection;

determining that the altitude selection is valid; and after determining that the received altitude selection is valid, presenting ITP altitude change request information based on the received altitude selection at an ITP user interface associated with the ITP display device;

at a multifunction control display unit (MCDU) comprising a MCDU display device:

presenting an MCDU user interface at the MCDU display device, the MCDU user interface comprising an ITP altitude change request template for creating a free-text ITP altitude change quest, the ITP altitude change request template comprising a plurality of fields on a single screen for receiving ITP altitude change request information based on the ITP altitude change request information being presented at the ITP display device of the ITP unit;

creating a free-text ITP altitude change request from the ITP altitude change request information received in the plurality of fields of the ITP altitude change request template based on content of the plurality of fields; and sending to Air Traffic Control (ATC) via the communication component the created free-text ITP altitude change request.

4. The method of claim 3, wherein the fields comprise:

the selected altitude of the host aircraft;

aircraft identification for one or more reference aircraft;

distance of the one or more reference aircraft from the host aircraft; and location information of the one or more reference aircraft relative to the host aircraft.

5. The system of claim 1, wherein the ITP unit is further configured to receive the altitude selection at the ITP user interface associated with the ITP display device.

6. The system of claim 1, wherein the MDCU is further configured to create the free-text ITP altitude change request in a format consistent with the ITP altitude change request template.

7. The method of claim 3, wherein receiving the altitude selection at the ITP unit comprises receiving the altitude selection at the ITP user interface associated with the ITP display device.

8. The method of claim 3, further comprising, at the MCDU, prior to sending the created free-text ITP altitude change request to ATC via the communication component, presenting the free-text ITP altitude change request at the MCDU user interface being presented at the MCDU display device.

* * * * *